US011541970B1

(12) United States Patent
Boyd et al.

(10) Patent No.: US 11,541,970 B1
(45) Date of Patent: Jan. 3, 2023

(54) WIND BLOCK SEAT ASSEMBLY

(71) Applicant: Protomet Corporation, Oak Ridge, TN (US)

(72) Inventors: Stewart Boyd, Oak Ridge, TN (US); William Matthew Reid, Knoxville, TN (US); Dale Lee Lambert, Oak Ridge, TN (US)

( * ) Notice: Subject to any disclaimer, the term of this patent is extended or adjusted under 35 U.S.C. 154(b) by 0 days.

(21) Appl. No.: 17/807,402

(22) Filed: Jun. 17, 2022

Related U.S. Application Data

(60) Provisional application No. 63/261,766, filed on Sep. 28, 2021.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | | |
|---|---|---|---|---|
| 1,178,285 | A | 4/1916 | Adams | |
| 1,465,925 | A | 8/1923 | Steel | |
| 2,383,178 | A | 8/1945 | Edwards | |
| 2,480,552 | A | 8/1949 | Colvez | |
| 3,175,860 | A | 3/1965 | Tchemiavsky | |
| 3,630,569 | A | 12/1971 | Lory | |
| 3,964,785 | A | 6/1976 | Plume | |
| 4,470,629 | A | 9/1984 | Collins, Jr. | |
| 5,056,849 | A | 10/1991 | Norris, Jr. et al. | |
| 5,098,154 | A | 3/1992 | Emery | |
| 6,679,556 | B1 | 1/2004 | Alvestad | |
| 6,715,825 | B2 | 4/2004 | Tame | |
| 7,156,442 | B2 | 1/2007 | McManus et al. | |
| 7,523,988 | B1 * | 4/2009 | Ratza | B60N 2/7011 297/284.4 |
| 7,661,382 | B2 | 2/2010 | Wood et al. | |
| 7,726,730 | B2 | 6/2010 | Peter et al. | |
| 8,113,137 | B2 | 2/2012 | Thompson | |
| 8,740,297 | B1 | 6/2014 | Foss et al. | |
| 8,899,168 | B1 * | 12/2014 | Fodor | B63B 27/146 114/361 |
| 9,003,997 | B2 | 4/2015 | Gratz et al. | |
| 9,021,975 | B1 | 5/2015 | Fodor et al. | |
| 9,073,608 | B1 * | 7/2015 | Foss | A47C 17/162 |
| 9,315,238 | B2 | 4/2016 | Neese et al. | |
| 9,440,560 | B2 | 9/2016 | Neese et al. | |
| 9,650,117 | B2 | 5/2017 | Curts et al. | |
| 9,688,168 | B2 | 6/2017 | Gratz | |

(Continued)

*Primary Examiner* — S. Joseph Morano
*Assistant Examiner* — Jovon E Hayes
(74) *Attorney, Agent, or Firm* — Robinson IP Law, PLLC

(57) ABSTRACT

A seat assembly includes: a backrest having a cushion surface formed on a first side of the backrest and support surface formed on a second side of the backrest; a first track assembly located along a first side of the backrest and a second track assembly located along a second side of the backrest; and a plurality of guide pins extending from the backrest into the first track assembly and the second track assembly such that the backrest is movable along the first track assembly and the second track assembly on the plurality of guide pins between a stowed position and a deployed position.

20 Claims, 5 Drawing Sheets

(56) References Cited

U.S. PATENT DOCUMENTS

| | | | | |
|---|---|---|---|---|
| 9,783,271 | B2 | 10/2017 | Foss et al. | |
| 9,821,887 | B1 * | 11/2017 | Wilson | B63B 29/04 |
| 10,005,380 | B2 | 6/2018 | Reid et al. | |
| 10,065,711 | B2 | 9/2018 | Fuller, IV et al. | |
| 10,149,544 | B2 | 12/2018 | Fafard et al. | |
| 10,150,539 | B1 | 12/2018 | Wilson et al. | |
| 10,150,540 | B2 | 12/2018 | Lake et al. | |
| 10,336,411 | B2 | 7/2019 | Curts et al. | |
| 10,494,061 | B2 * | 12/2019 | Fafard | B63B 29/04 |
| 10,569,841 | B2 | 2/2020 | Fuller, IV et al. | |
| 10,604,217 | B2 | 3/2020 | Curts et al. | |
| 10,933,774 | B2 | 3/2021 | Curts | |
| 11,027,795 | B2 | 6/2021 | Curts et al. | |
| 11,034,414 | B1 | 6/2021 | Wilson et al. | |
| 11,091,230 | B2 | 8/2021 | Curts et al. | |
| 11,174,893 | B1 * | 11/2021 | Freer | F16C 1/16 |
| 11,186,347 | B1 * | 11/2021 | Levin | F16C 11/0685 |
| 11,230,355 | B1 | 1/2022 | Curts et al. | |
| 11,267,538 | B2 * | 3/2022 | Ekern | B63B 29/04 |
| 11,286,022 | B1 * | 3/2022 | Freer | B63B 29/04 |
| 2008/0066672 | A1 | 3/2008 | Eekhoff et al. | |
| 2010/0037813 | A1 * | 2/2010 | Sahr | B63B 29/04 114/363 |
| 2017/0305307 | A1 | 10/2017 | Reid et al. | |
| 2018/0229817 | A1 * | 8/2018 | Fafard | B63B 29/04 |
| 2019/0118678 | A1 * | 4/2019 | Stevens | B60N 2/06 |

* cited by examiner

WIND BLOCK SEAT ASSEMBLY

CROSS-REFERENCE TO RELATED APPLICATION

This application claims priority to and is a non-provisional of U.S. patent application Ser. No. 63/261,766 for a "Wind Block Flip Seat" filed on Sep. 28, 2021, the contents of which are incorporated herein by reference in its entirety.

FIELD

This disclosure relates to the field of marine products. More particularly, this disclosure relates to a convertible seat arrangement for providing seating in a watercraft.

BACKGROUND

Many types of recreational watercraft include an open bow that allows for passengers to sit in the open bow of the watercraft. Seats in an open bow watercraft are typically arranged along sides and at the front of the bow. To access the bow, a walk-through is typically located through the windshield and helm of the boat to allow passengers to access the bow seating area of the boat.

In existing arrangements of seating in an open bow watercraft, the location of a walk-through precludes allowing passengers to sit at the walk-through. Although some open bow watercraft may include a wind screen or other element to attempt to block wind at the walk-through area, those screens do not allow passengers to sit in front of the screen.

What is needed, therefore, is a seating arrangement for an open bow watercraft that allows a seat back to be movably located at the walk-through area to provide additional seating at the bow of the watercraft.

BRIEF DESCRIPTION OF THE DRAWINGS

The above and other needs are met by a seat assembly that is movable between a deployed position and a stowed position at a walk through of a watercraft. In some aspects, the techniques described herein relate to a watercraft including: an open bow area located towards a bow of the watercraft; a walk through located adjacent to the open bow area; a first track assembly located on a first side of the walk through; a second track assembly located on a second side of the walk through; and a backrest movably mounted on the first track assembly and the second track assembly, the backrest movable between a stowed position and a deployed position; wherein in the deployed position, the backrest is substantially upright relative to the watercraft and the backrest is located across the walk through; and wherein in the stowed position, the backrest is substantially horizontal relative to the watercraft and the backrest is located adjacent a floor of the open bow area of the watercraft.

In some aspects, the techniques described herein relate to a watercraft, the backrest further including a plurality of guide pins extending therefrom, the plurality of guide pins shaped to fit within the first track assembly and the second track assembly such that the backrest moves along the first track assembly and the second track assembly when moving from the stowed position to the deployed position.

Figure 1:
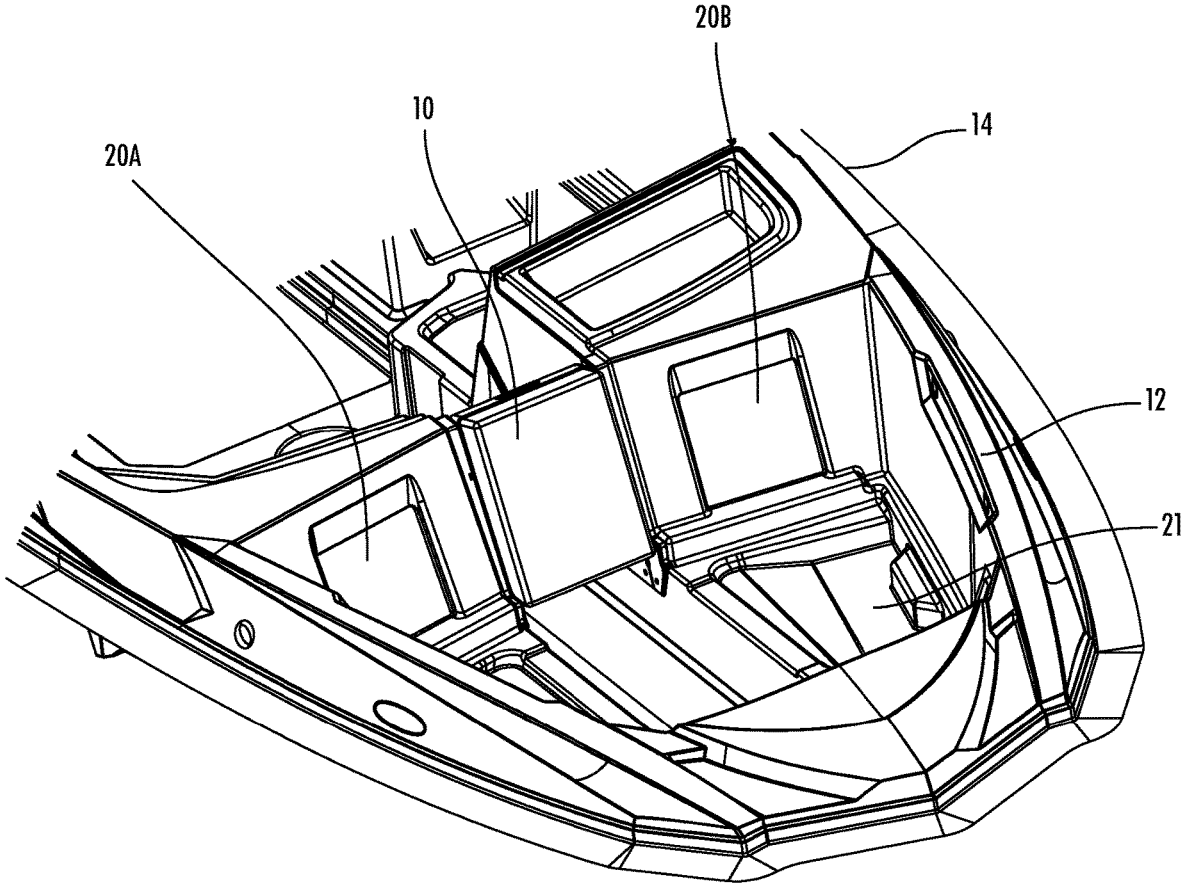

In some aspects, the techniques described herein relate to a watercraft, each of the first track assembly and the second track assembly including an upper track portion oriented substantially vertically on the first track assembly and the second track assembly and a lower track portion oriented substantially horizontal on the first track assembly and the second track assembly.

In some aspects, the techniques described herein relate to a watercraft: the plurality of guide pins including a pair of upper guide pins located towards an upper end of the backrest assembly when the backrest assembly is deployed, and a pair of lower guide pins located towards a lower end of the backrest assembly when the backrest assembly is deployed; wherein the pair of upper guide pins are movable along the upper track portion when the backrest moves between the deployed position and the stowed position; and wherein the pair of lower guide pins are movable along the lower track portion when the backrest moves between the deployed position and the stowed position.

In some aspects, the techniques described herein relate to a watercraft, the backrest further including a cushion surface located on a first side of the backrest and a support surface located on a second side of the backrest opposite to the cushion surface.

In some aspects, the techniques described herein relate to a watercraft: wherein when the backrest is in the stowed position, the support surface located on the second side of the backrest is facing upward relative to the watercraft; and wherein when the backrest is in the deployed position, the cushion surface is facing towards the bow of the watercraft.

In some aspects, the techniques described herein relate to a watercraft, the first track assembly and the second track assembly including an extension portion for releasing the backrest from the first track assembly and the second track assembly.

In some aspects, the techniques described herein relate to a seat assembly including: a backrest having a cushion surface formed on a first side of the backrest and a support surface formed on a second side of the backrest; a first track assembly located along a first side of the backrest and a second track assembly located along a second side of the backrest; and a plurality of guide pins extending from the backrest into the first track assembly and the second track assembly such that the backrest is movable along the first track assembly and the second track assembly on the plurality of guide pins between a stowed position and a deployed position; wherein in the deployed position, the backrest is substantially upright on the first track assembly and the second track assembly; and wherein in the stowed position, the backrest is substantially horizontal on the first track assembly and the second track assembly.

In some aspects, the techniques described herein relate to a seat assembly, each of the first track assembly and the second track assembly including an upper track portion oriented substantially vertically on the first track assembly and the second track assembly and a lower track portion oriented substantially horizontal on the first track assembly and the second track assembly.

In some aspects, the techniques described herein relate to a seat assembly: the plurality of guide pins including a pair of upper guide pins located towards an upper end of the backrest assembly when the backrest assembly is deployed, and a pair of lower guide pins located towards a lower end of the backrest assembly when the backrest assembly is deployed; wherein the pair of upper guide pins are movable along the upper track portion when the backrest moves between the deployed position and the stowed position; and wherein the pair of lower guide pins are movable along the lower track portion when the backrest moves between the deployed position and the stowed position.

In some aspects, the techniques described herein relate to a seat assembly, wherein the upper track portion is connected to the lower track portion.

In some aspects, the techniques described herein relate to a seat assembly, further including an extension portion extending from one of the upper track portion and the lower track portion of the first track assembly and the second track assembly.

In some aspects, the techniques described herein relate to a seat assembly, the backrest further including a cushion surface located on a first side of the backrest and a support surface located on a second side of the backrest opposite to the cushion surface.

In some aspects, the techniques described herein relate to a seat assembly: wherein when the backrest is in the stowed position, the support surface located on the second side of the backrest is facing upward; and wherein when the backrest is in the deployed position, the cushion surface is facing forward.

In some aspects, the techniques described herein relate to a seat assembly including: a backrest having a cushion surface formed on a first side of the backrest and a support surface formed on a second side of the backrest; a first track assembly located along a first side of the backrest and a second track assembly located along a second side of the backrest, the first track assembly and the second track assembly including an upper track portion oriented substantially vertically on the first track assembly and the second track assembly and a lower track portion oriented substantially horizontal on the first track assembly and the second track assembly; a pair of upper guide pins located towards an upper end of the backrest assembly when the backrest assembly is deployed, the upper guide pins movable along the upper track portion; and a pair of lower guide pins located towards a lower end of the backrest assembly when the backrest assembly is deployed; wherein the pair of upper guide pins are movable along the upper track portion when the backrest moves between a deployed position and a stowed position; and wherein the pair of lower guide pins are movable along the lower track portion when the backrest moves between the deployed position and the stowed position.

In some aspects, the techniques described herein relate to a seat assembly, wherein the upper track portion is connected to the lower track portion.

In some aspects, the techniques described herein relate to a seat assembly, the backrest further including a cushion surface located on a first side of the backrest and a support surface located on a second side of the backrest opposite to the cushion surface.

In some aspects, the techniques described herein relate to a seat assembly: wherein when the backrest is in the stowed position, the support surface located on the second side of the backrest is facing upward; and wherein when the backrest is in the deployed position, the cushion surface is facing forward.

In some aspects, the techniques described herein relate to a seat assembly, the lower track portion of the first track assembly and the second track assembly further including a rest portion for receiving the pair of lower guide pins therein when the backrest is in the deployed position.

In some aspects, the techniques described herein relate to a seat assembly, further including an extension portion extending from one of the upper track portion and the lower track portion of the first track assembly and the second track assembly.

BRIEF DESCRIPTION OF THE DRAWINGS

Figure 2:
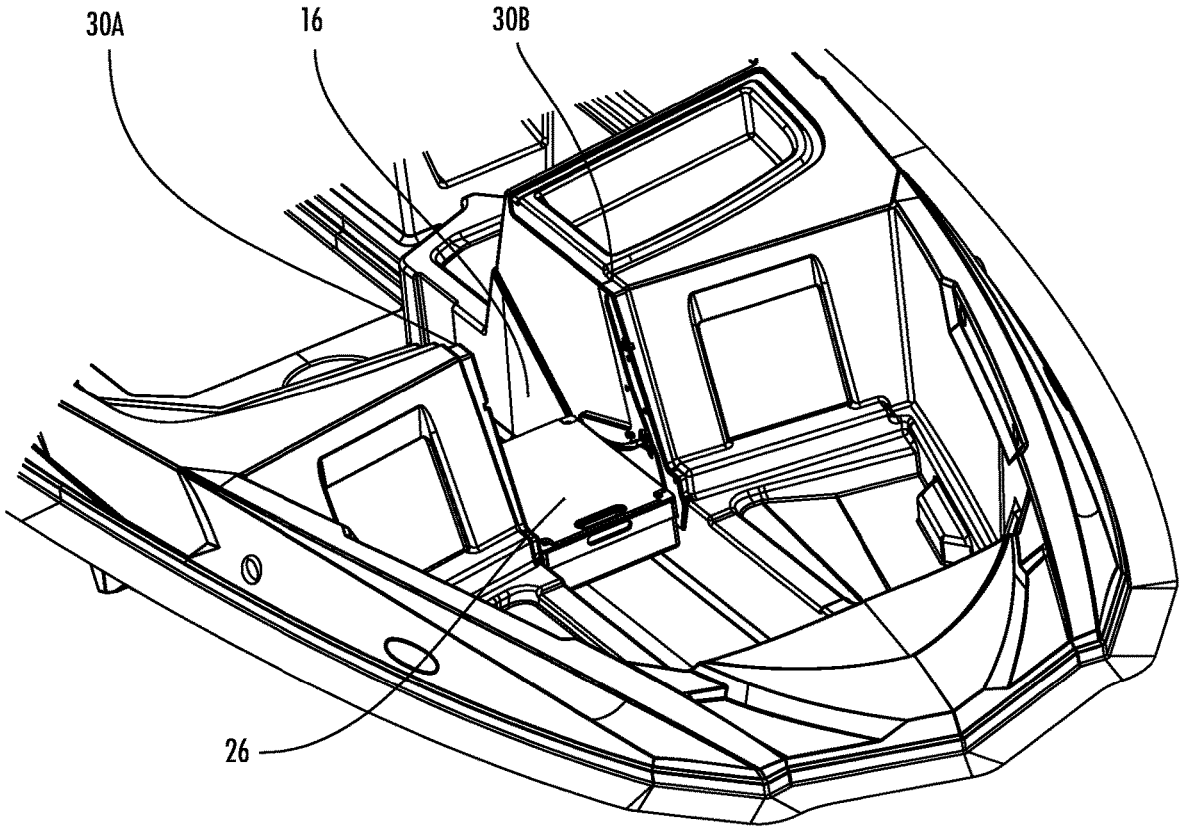
Figure 3:
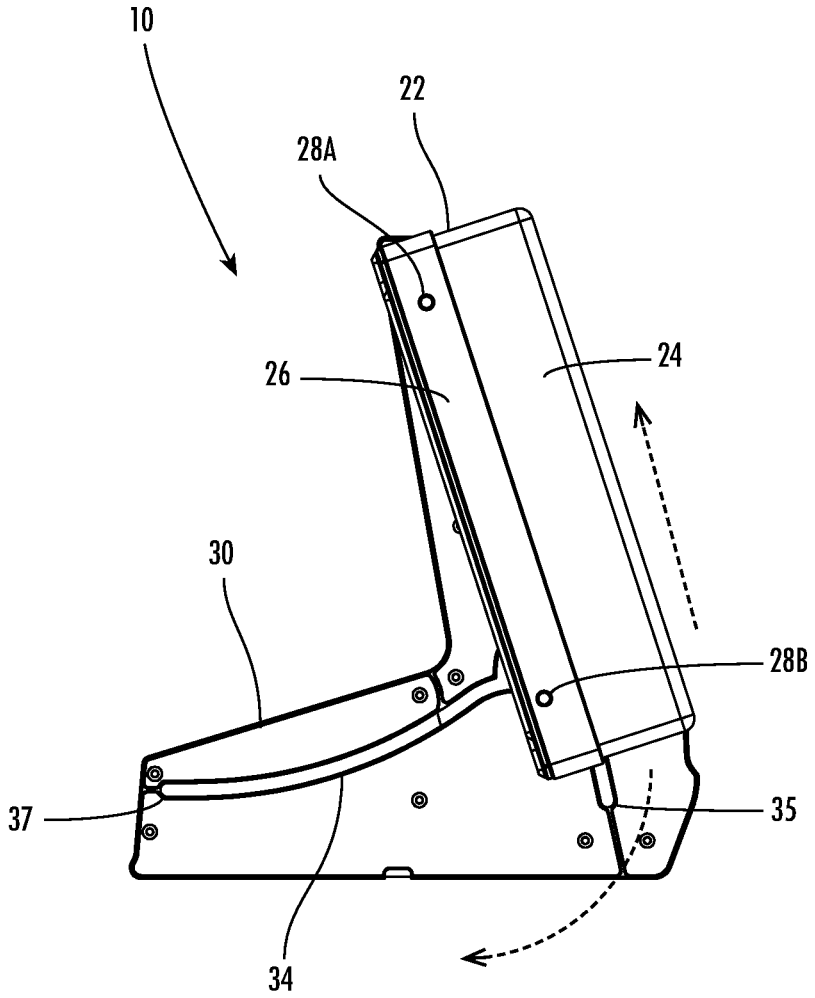
Figure 4:
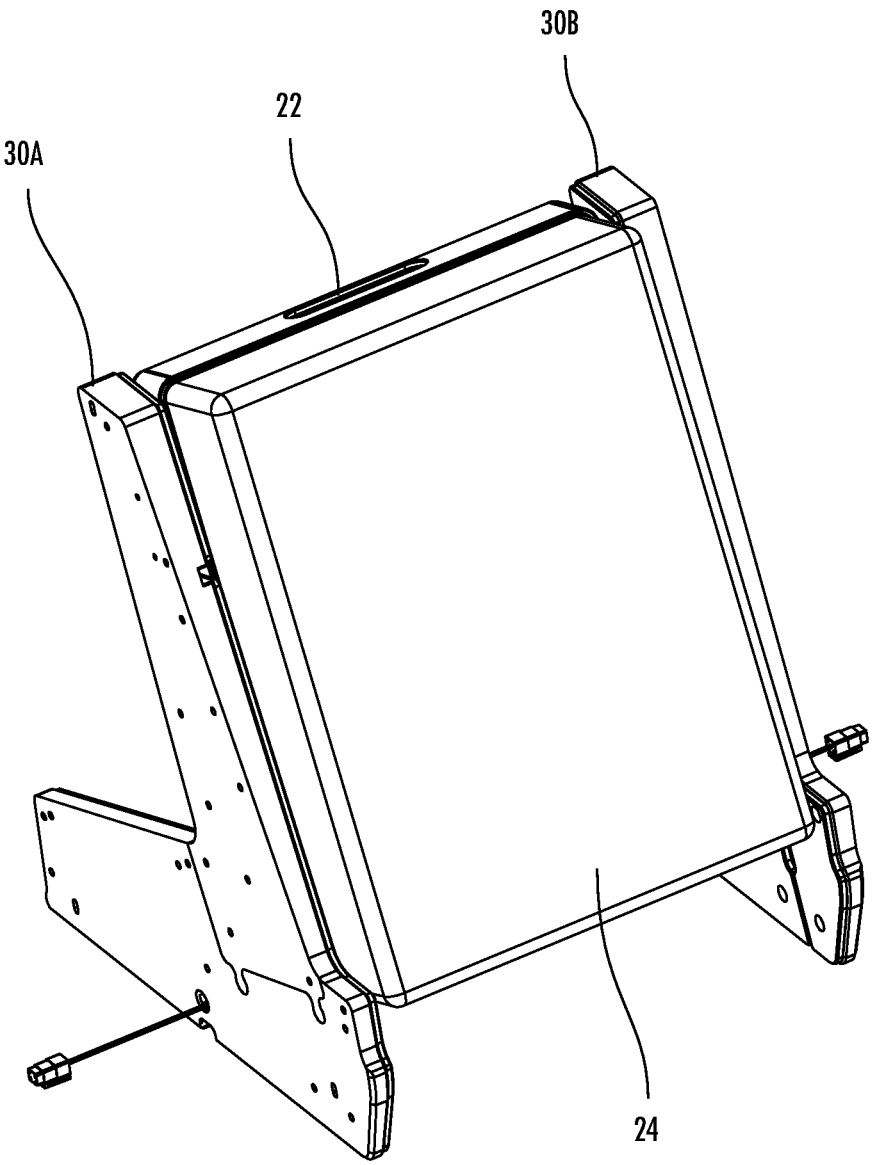
Figure 5:
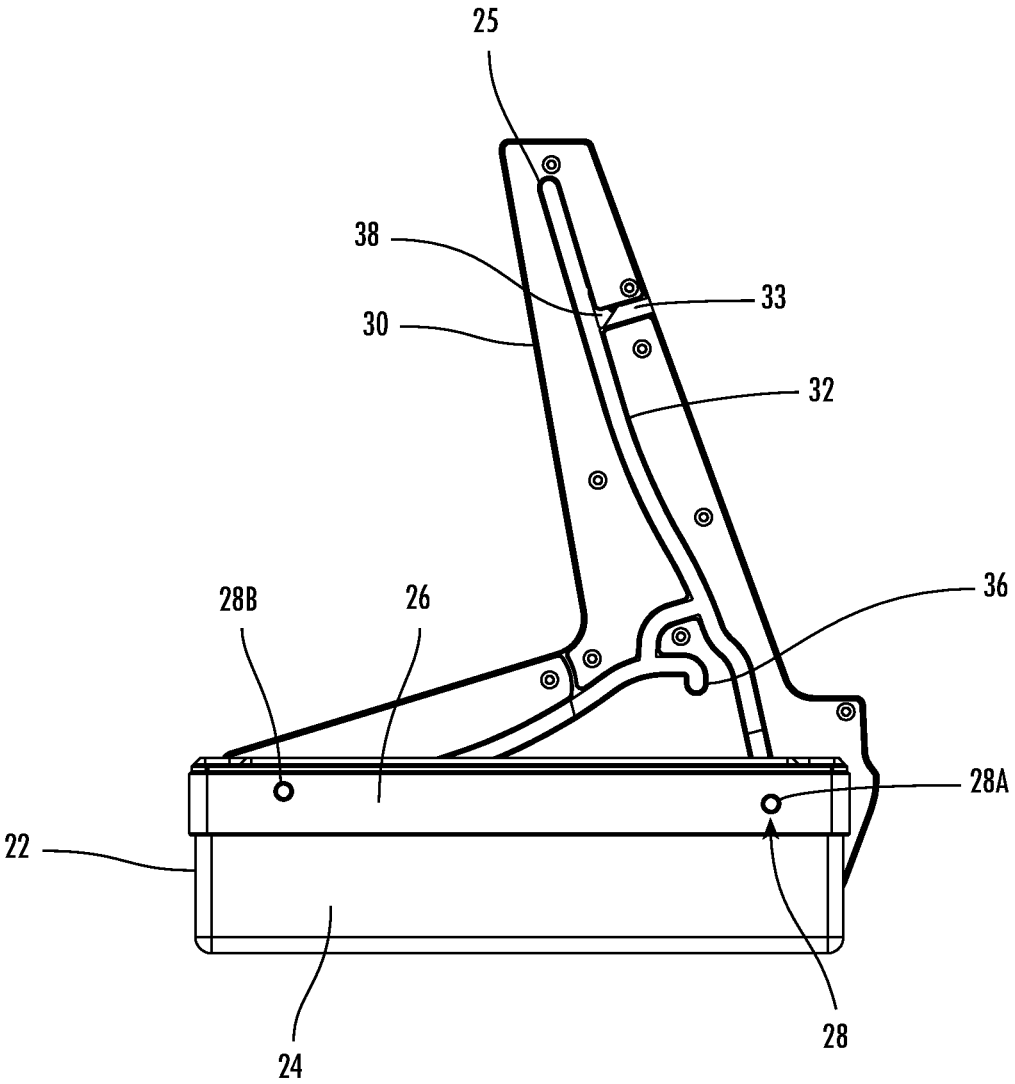

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

FIG. 1 shows a perspective view of a wind block seat assembly with the seat assembly in a deployed position according to one embodiment of the present disclosure;

FIG. 2 shows a perspective view of a watercraft having a wind block seat assembly with the seat assembly in a stowed position according to one embodiment of the present disclosure;

FIG. 3 shows a side plan view of a wind block seat assembly in a deployed position according to one embodiment of the present disclosure;

FIG. 4 shows a perspective view of a wind block seat assembly in a deployed position according to one embodiment of the present disclosure; and FIG. 5 shows a side plan view of a wind block seat assembly in a stowed position according to one embodiment of the present disclosure.

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

FIG. 1 shows a basic embodiment of a seat assembly 10. The seat assembly 10 may be located on an open bow area 12 of a watercraft 14, such as to provide seating at the open bow of the watercraft. The seat assembly 10 may be located in the open bow area 12 of the watercraft 14 and is movable such that the seat assembly 10 may be configured in a deployed position (FIG. 1) or a stowed position (FIG. 2). The seat assembly 10 advantageously allows for additional seating in the open bow area 12 of the watercraft 14 while also allowing for passengers to easily enter and exit the open bow area 12 of the watercraft 14 through a walk through 16 (FIG. 2) of the watercraft 14. Further, the seat assembly 10 may be movable such that when the seat assembly 10 is in the stowed position as shown in FIG. 2, a back of the seat assembly 10 provides a surface for passengers to step during ingress and egress of the open bow area 12 of the watercraft 14 as discussed in greater detail herein.

Referring to FIG. 1, the open bow area 12 of the watercraft 14 may include additional seating, such as opposing backrests 20A and 20B located on opposing sides of the seat assembly 10. The backrests 20A and 20B may be fixed in position, such as backrests utilized on existing open bow watercraft. The open bow area 12 may further include a plurality of bottom cushions 21 located along a floor of the open bow area 12 of the watercraft 14.

Referring to FIG. 3, the seat assembly 10 includes a backrest 22. The backrest 22 includes a cushion surface 24 on a first side of the backrest 22 for supporting a back of a passenger seated in the open bow area 12 of the watercraft 14. The cushion surface 24 may be formed, for example, of a deformable material that provides comfortable support to a back of a passenger resting against the backrest 22 when the seat assembly 10 is deployed. The backrest 22 further includes an opposing support surface 26. The support surface 26 may be located opposite the cushion surface 24 and may be constructed such that the support surface 26 provides a durable and solid surface for a passenger to step when the seat assembly 10 is in the stowed position as described in greater detail herein. The support surface 26 may be formed, for example, of a metal or a hardened polymer such that the support surface 26 is capable of supporting a weight of a passenger stepping on the support surface 26 without substantially deforming when the seat assembly 10 is in the stowed position.

The cushion surface 24 may be mounted on the support surface 26 such that the support surface 26 provides a base for supporting the cushion surface 24 thereon. The backrest 22 may include a plurality of guide pins 28. The plurality of guide pins 28 may be located along opposing sides of the backrest 22. FIG. 3 shows a cross-sectional side view of the wind block seat in a deployed position. As shown in FIG. 3, the plurality of guide pins 28 may be arranged such that the plurality of guide pins 28 are located towards a top and bottom of sides of the backrest assembly for guiding movement of the backrest 22 as discussed in greater detail herein.

The seat assembly 10 may include one or more track assemblies 30 that are arranged to movably support the backrest 22 while allowing the seat assembly 10 to move between deployed and stowed positions. As shown in FIG. 4, the backrest 22 may be supported on a first track assembly 30A and a second track assembly 30B. The first track assembly 30A and the second track assembly 30B may be mounted to the watercraft 14, such as by mounting the track assemblies 30 to the watercraft at sides of the walk through 16 of the watercraft 14 as shown in FIG. 2. The track assemblies 30 may be mounted to the watercraft 14 with, for example, a plurality of fasteners located through the track assemblies 30.

The one or more track assemblies 30 are shaped to guide movement of the backrest 22 between a deployed position as shown in FIG. 1, and stowed a position as shown in FIG. 2. The one or more track assemblies 30 may be shaped to receive the plurality of guide pins 28 thereon such that the guide pins 28 slide along one or more tracks of the one or more track assemblies 30. The one or more track assemblies 30 may be mounted on the watercraft 14 at a width such that the plurality of guide pins 28 extending from sides of the backrest 22 fit into one or more tracks of the track assemblies 30 while allowing the plurality of guide pins 28 to slide within the one or more tracks of the track assemblies 30.

Referring to FIG. 5, the one or more tracks may include an upper track portion 32 oriented substantially vertically or inclined relative to the watercraft 14 such that when an upper portion of the backrest 22 is upright or inclined to support a passenger when the seat assembly 10 is in a deployed position. The upper track portion 32 extends substantially along a height of the track assemblies 30 as shown in FIG. 3. The upper track portion 32 may include an extension portion 33 that allows for removal of the backrest 22. The extension portion 33 may, for example, connect to and extend substantially perpendicular from the upper track portion 32 through a front portion or side of the one or more track assemblies 30 such that the plurality of guide pins 28 may be disengaged from the track assemblies 30 during removal of the backrest 22 to allowing releasing of the backrest 22 from the track assemblies 30.

Referring again to FIG. 3, the one or more tracks of the track assemblies 30 may include a lower track portion 34 oriented substantially horizontal relative to the watercraft such that a portion of the backrest 22 may engage the lower track portion 34 to move the backrest 22 into a stowed position wherein the support surface 26 is facing upwards. The lower track portion 34 may extend from a first end where the lower track portion 34 is proximate to a lower portion of the upper track portion 32 to a second end that is distal from the first end.

The lower track portion 34 may include a rest portion 36 (FIG. 5) located towards the first end of the lower track portion 34. The rest portion may be shaped to receive a lower of the plurality of guide pins 28 therein when the backrest 22 is in a deployed position. The rest portion 36 may prevent sliding of the lower of the plurality of guide pins 28 along the lower track portion 34 when the backrest 22 is in a deployed position. The rest portion 36 may be disengaged by a lower of the plurality of guide pins 28 to allow the backrest 22 to move towards a stowed position, such as by lifting of the backrest assembly to disengage the plurality of guide pins 28 from the rest portion 36. The lower track portion 34 may be connected to the upper track portion 32 such that the guide pins 28 may move from the lower track portion 34 to the upper track portion 32 during removal of the backrest 22, as described in greater detail herein.

The backrest 22 is movable between deployed and stowed positions. Referring again to FIG. 1, the backrest 22 is shown in the deployed position. In the deployed position, the backrest assembly is substantially upright or inclined in front of the walk through 16 of the watercraft 14 such that the backrest 22 supports a passenger seated in front of the walk through 16 in the open bow area 12 of the watercraft 14. The upper guide pin 28A may be located proximate to an upper end 25 (FIG. 5) of the upper track portion 32. The lower guide pin 28B may be located at the rest portion 36, thereby maintaining the backrest 22 in a substantially upright orientation relative to the watercraft 14. In the deployed position, the seat assembly 10 is arranged such that the backrest 22 is located substantially across the walk through 16 of the watercraft 14 to serve as a backrest for a passenger seated at a center of the open bow area 12. In the deployed position, the cushion surface 24 of the backrest 22 is substantially aligned with backrests 20A and 20B located on opposing sides of the seat assembly 10. The backrests 20A and 20B may be fixed in position, such as backrests utilized on existing open bow watercraft. In the deployed position, the backrest 22 substantially blocks wind flowing through the walk through 16 of the watercraft 14. The backrest 22 may be proximate to a lower edge of a windshield of the watercraft 14 when in the deployed position and the cushion surface 24 may face forward or towards a bow of the watercraft 14 on which the seat assembly 10 is installed.

In the stowed position, the backrest 22 is substantially flat or horizontal such that the backrest 22 allows for passage of passengers through the walk through 16 of the watercraft 14. FIG. 2 and FIG. 5 illustrate the backrest 22 in the stowed position. In the stowed position, the cushion surface 24 may be facing downward relative to the watercraft 14 while the support surface 26 is facing upward to allow passengers to step on the support surface 26 when entering or leaving the open bow area 12 of the watercraft 14. The backrest 22 may be substantially flat relative to the open bow area 12 of the watercraft 14 to allow ready ingress and egress from the open bow area 12 when the backrest 22 is in the stowed position. The backrest 22 may be oriented such that when in the stowed position, the backrest 22 is adjacent to the floor of the open bow area 12 of the watercraft 14.

To move between the deployed and stowed positions, the plurality of guide pins 28 may move along the upper track portion 32 and the lower track portion 34 when the backrest 22 is moved. When the backrest 22 is in the deployed position as shown in FIG. 3, an upper guide pin 28A of the guide pins 28 may be located towards an upper end of the upper track portion 32 while a lower guide pin 28B of the guide pins 28 may be engaged with the rest portion 36 as shown in FIG. 5 of the lower track portion 34. In the deployed position, the lower guide pin 28B may be prevented from moving along the lower track portion 34 by the rest portion 36 when a passenger is leaning against the backrest 22. The seat assembly 10 may include a pair of the upper guide pins 28A located on sides of the backrest 22. The seat assembly may include a pair of the lower guide pins 28B located on sides of the backrest.

To move the backrest 22 to the stowed position, the backrest assembly is first moved in an upward direction relative to the track assemblies 30 to disengage the lower guide pin 28B from the rest portion 36. By lifting the backrest 22, the lower guide pin 28B disengages the rest portion 36 and is allowed to travel along the lower track portion 34 away from the upper track portion 32. As the lower guide pin 28B travels along the lower track portion 34, the upper guide pin 28A may travel substantially downward towards a bottom of the upper track portion 32 until the backrest 22 reaches the position shown in FIG. 5. Movement of the lower guide pin 28B along the lower track portion 34 away from the upper track portion 32 allows the backrest 22 to pivot or rotate relative to the track assemblies 30. The resulting movement of the backrest 22 from the deployed position to the stowed position allows the backrest assembly to substantially flip such that the cushion surface 24 faces substantially downwardly while the support opposing support surface 26 faces upwardly to allows passengers to step thereon. When the backrest 22 is in the stowed position, the upper guide pin 28A of the backrest 22 is towards a bottom end 35 (FIG. 3) of the upper track portion 32 and the lower guide pin 28B is towards a distal end 37 of the lower track portion 34.

The track assemblies 30 may include a toggle 38 that prevents the plurality of guide pins 28 from moving along the extension portion 33. The toggle 38 may be biased, such as with a spring, into a closed position as shown in FIG. 5 to substantially prevent the plurality of guide pins 28 from travelling along the extension portion 33 and the backrest 22 being removed. A user may engage the toggle 38 to an open position, thereby allowing the plurality of guide pins 28 to travel along the extension portion 33 and for the plurality of guide pins 28 to disengage from the track assemblies 30. The backrest 22 may be subsequently removed by the upper guide pin first travelling along the extension portion 33 and out of the track assemblies 30, followed by the lower guide pin travelling from the lower track portion 34 to the upper track portion 32 and out of the track assemblies at the extension portion 33.

The seat assembly 10 advantageously allows the backrest 22 to be readily located across the walk through 16 to both provide support for a passenger seated at a center of the open bow area 12 and to also block wind from flowing through the walk through 16. The seat assembly 10 allows the backrest assembly to be easily moved to the stowed position to provide a surface for passengers to step and to provide substantially unobstructed access to the open bow area 12 when the backrest 22 is not needed for supporting a passenger.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A watercraft comprising:

an open bow area located towards a bow of the watercraft;

a walk through located adjacent to the open bow area;

a first track assembly located on a first side of the walk through;

a second track assembly located on a second side of the walk through; and a backrest movably mounted on the first track assembly and the second track assembly, the backrest movable between a stowed position and a deployed position;

wherein in the deployed position, the backrest is substantially upright relative to the watercraft and the backrest is located across the walk through; and wherein in the stowed position, the backrest is substantially horizontal relative to the watercraft and the backrest is located adjacent a floor of the open bow area of the watercraft.

2. The watercraft of claim 1, the backrest further comprising a plurality of guide pins extending therefrom, the plurality of guide pins shaped to fit within the first track assembly and the second track assembly such that the backrest moves along the first track assembly and the second track assembly when moving from the stowed position to the deployed position.

3. The watercraft of claim 2, each of the first track assembly and the second track assembly comprising an upper track portion oriented substantially vertically on the first track assembly and the second track assembly and a lower track portion oriented substantially horizontal on the first track assembly and the second track assembly.

4. The watercraft of claim 3:

the plurality of guide pins including a pair of upper guide pins located towards an upper end of the backrest assembly when the backrest assembly is deployed, and a pair of lower guide pins located towards a lower end of the backrest assembly when the backrest assembly is deployed;

wherein the pair of upper guide pins are movable along the upper track portion when the backrest moves between the deployed position and the stowed position; and wherein the pair of lower guide pins are movable along the lower track portion when the backrest moves between the deployed position and the stowed position.

5. The watercraft of claim 1, the backrest further comprising a cushion surface located on a first side of the backrest and a support surface located on a second side of the backrest opposite to the cushion surface.

6. The watercraft of claim 5:

wherein when the backrest is in the stowed position, the support surface located on the second side of the backrest is facing upward relative to the watercraft; and wherein when the backrest is in the deployed position, the cushion surface is facing towards the bow of the watercraft.

7. The watercraft of claim 1, the first track assembly and the second track assembly comprising an extension portion for releasing the backrest from the first track assembly and the second track assembly.

8. A seat assembly comprising:

a backrest having a cushion surface formed on a first side of the backrest and a support surface formed on a second side of the backrest;

a first track assembly located along a first side of the backrest and a second track assembly located along a second side of the backrest; and a plurality of guide pins extending from the backrest into the first track assembly and the second track assembly such that the backrest is movable along the first track assembly and the second track assembly on the plurality of guide pins between a stowed position and a deployed position;

wherein in the deployed position, the backrest is substantially upright on the first track assembly and the second track assembly; and wherein in the stowed position, the backrest is substantially horizontal on the first track assembly and the second track assembly.

9. The seat assembly of claim 8, each of the first track assembly and the second track assembly comprising an upper track portion oriented substantially vertically on the first track assembly and the second track assembly and a lower track portion oriented substantially horizontal on the first track assembly and the second track assembly.

10. The seat assembly of claim 9:

the plurality of guide pins including a pair of upper guide pins located towards an upper end of the backrest assembly when the backrest assembly is deployed, and a pair of lower guide pins located towards a lower end of the backrest assembly when the backrest assembly is deployed;

wherein the pair of upper guide pins are movable along the upper track portion when the backrest moves between the deployed position and the stowed position; and wherein the pair of lower guide pins are movable along the lower track portion when the backrest moves between the deployed position and the stowed position.

11. The seat assembly of claim 10, wherein the upper track portion is connected to the lower track portion.

12. The seat assembly of claim 11, further comprising an extension portion extending from one of the upper track portion and the lower track portion of the first track assembly and the second track assembly.

13. The seat assembly of claim 8, the backrest further comprising a cushion surface located on a first side of the backrest and a support surface located on a second side of the backrest opposite to the cushion surface.

14. The seat assembly of claim 13:

wherein when the backrest is in the stowed position, the support surface located on the second side of the backrest is facing upward; and wherein when the backrest is in the deployed position, the cushion surface is facing forward.

15. A seat assembly comprising:

a backrest having a cushion surface formed on a first side of the backrest and a support surface formed on a second side of the backrest;

a first track assembly located along a first side of the backrest and a second track assembly located along a second side of the backrest, the first track assembly and the second track assembly including an upper track portion oriented substantially vertically on the first track assembly and the second track assembly and a lower track portion oriented substantially horizontal on the first track assembly and the second track assembly;

a pair of upper guide pins located towards an upper end of the backrest assembly when the backrest assembly is deployed, the upper guide pins movable along the upper track portion; and a pair of lower guide pins located towards a lower end of the backrest assembly when the backrest assembly is deployed;

wherein the pair of upper guide pins are movable along the upper track portion when the backrest moves between a deployed position and a stowed position; and wherein the pair of lower guide pins are movable along the lower track portion when the backrest moves between the deployed position and the stowed position.

16. The seat assembly of claim 15, wherein the upper track portion is connected to the lower track portion.

17. The seat assembly of claim 15, the backrest further comprising a cushion surface located on a first side of the backrest and a support surface located on a second side of the backrest opposite to the cushion surface.

18. The seat assembly of claim 17:

wherein when the backrest is in the stowed position, the support surface located on the second side of the backrest is facing upward; and wherein when the backrest is in the deployed position, the cushion surface is facing forward.

19. The seat assembly of claim 15, the lower track portion of the first track assembly and the second track assembly further comprising a rest portion for receiving the pair of lower guide pins therein when the backrest is in the deployed position.

20. The seat assembly of claim 15, further comprising an extension portion extending from one of the upper track portion and the lower track portion of the first track assembly and the second track assembly.

* * * * *